US007649133B2

(12) United States Patent
Lento

(10) Patent No.: US 7,649,133 B2
(45) Date of Patent: Jan. 19, 2010

(54) STRIKING MEMBER FOR USE WITH A PERCUSSION INSTRUMENT

(76) Inventor: James A. Lento, 290 White Plains Rd., Eastchester, NY (US) 10709

( * ) Notice: Subject to any disclaimer, the term of this patent is extended or adjusted under 35 U.S.C. 154(b) by 10 days.

(21) Appl. No.: 11/979,435

(22) Filed: Nov. 2, 2007

(65) Prior Publication Data

US 2009/0000459 A1 Jan. 1, 2009

Related U.S. Application Data

(60) Provisional application No. 60/929,453, filed on Jun. 28, 2007.

(51) Int. Cl.
*G10D 13/02* (2006.01)

(52) U.S. Cl. ..... 84/422.4

(58) Field of Classification Search ..... 84/422.4
See application file for complete search history.

(56) References Cited

U.S. PATENT DOCUMENTS 1,810,731 A * 6/1931 Roark ..... 84/422.4
2,012,158 A * 8/1935 Dewey ..... 84/477 B
2,318,460 A * 5/1943 Brief ..... 446/419
2,364,581 A * 12/1944 Zadek ..... 446/419
2,399,333 A * 4/1946 Desmond ..... 446/419
2,466,554 A * 4/1949 Mossey ..... 84/422.4
2,787,930 A * 4/1957 Della-Porta ..... 84/422.1
2,896,949 A * 7/1959 Dunker ..... 473/604
2,905,043 A * 9/1959 Soderberg ..... 84/422.4
3,069,804 A * 12/1962 Cirafesi ..... 446/266
3,137,194 A * 6/1964 Simpson, Jr. ..... 84/422.4
3,730,570 A 5/1973 Brochstein
3,847,395 A * 11/1974 Santilli ..... 473/526
4,246,826 A * 1/1981 Warrick et al. ..... 84/422.4
4,307,647 A 12/1981 Christian (Continued)

FOREIGN PATENT DOCUMENTS

JP 5181458 7/1993

OTHER PUBLICATIONS

"How to make Juggling Sticks", Nancy Beckwith, viewed Nov. 11, 2008 at www2.mesa.k12.co.us/physed/Equipment1.htm, attach tennis ball to a dowel.*

(Continued)

*Primary Examiner*—Jeffrey Donels
*Assistant Examiner*—Robert W Horn
(74) *Attorney, Agent, or Firm*—Richard C. Litman

(57) ABSTRACT

The striking member for use with a percussion instrument is a vibration-inducing and flexing variation of a conventional unitary or one-piece drum stick, drum mallet or the like. The striking member includes a stick having opposed first and second ends, and a hollow shell having an opening formed through a lower end thereof. The first end of the stick is adapted for grasping by the user, and the second end is inserted through the opening, into an open interior region of the hollow shell. The hollow shell is secured to the stick, and flexes when striking a surface, such as a drum, for example. An elastic material may further be received within the hollow shell, and may at least partially fill the open interior region thereof in order to provide further elastic properties for the head of the striking member.

18 Claims, 14 Drawing Sheets

U.S. PATENT DOCUMENTS

| | | | | | |
|---|---|---|---|---|---|
| 4,632,006 | A | | 12/1986 | Ambroszewski | |
| 4,649,792 | A | * | 3/1987 | Swartzlander | 84/422.4 |
| 4,803,907 | A | * | 2/1989 | Minker | 84/422.1 |
| 5,044,250 | A | * | 9/1991 | Beyer | 84/422.4 |
| 5,217,222 | A | * | 6/1993 | Rudell et al. | 473/528 |
| 5,265,514 | A | * | 11/1993 | Schertz | 84/422.4 |
| 5,341,716 | A | | 8/1994 | Donohoe | |
| 5,361,671 | A | | 11/1994 | Genna | |
| 5,400,685 | A | | 3/1995 | Cappella | |
| 5,477,768 | A | * | 12/1995 | Swift | 84/453 |
| 5,503,056 | A | | 4/1996 | Evans | |
| 5,503,057 | A | * | 4/1996 | Smith, Jr. | 84/422.4 |
| 5,602,355 | A | | 2/1997 | Lipp | |
| 5,693,900 | A | * | 12/1997 | Calato et al. | 84/422.4 |
| 5,728,958 | A | | 3/1998 | Vater | |
| 5,738,560 | A | * | 4/1998 | Bears | 446/220 |
| 5,816,580 | A | * | 10/1998 | Osborne et al. | 273/454 |
| 5,925,840 | A | * | 7/1999 | Senn | 84/422.4 |
| D422,310 | S | * | 4/2000 | Cohen | D19/46 |
| 6,056,464 | A | * | 5/2000 | Cohen | 401/52 |
| D428,298 | S | * | 7/2000 | Cohen | D7/300.2 |
| 6,146,236 | A | * | 11/2000 | Kay | 446/419 |
| 6,302,813 | B1 | * | 10/2001 | Sturgeon et al. | 473/564 |
| 6,307,138 | B1 | * | 10/2001 | Simpson | 84/422.4 |
| 6,392,129 | B1 | * | 5/2002 | Enhoffer et al. | 84/402 |
| D463,482 | S | * | 9/2002 | Cohen | D17/22 |
| 6,471,564 | B1 | * | 10/2002 | Coleman et al. | 446/267 |
| 6,668,414 | B1 | * | 12/2003 | Benjamin, Jr. | 15/104.001 |
| 6,759,583 | B2 | * | 7/2004 | Mizuno et al. | 84/422.4 |
| 7,045,695 | B1 | * | 5/2006 | Cohen | 84/402 |
| 7,084,339 | B2 | | 8/2006 | Rundle | |
| 7,176,369 | B1 | * | 2/2007 | Brooks | 84/422.4 |
| 7,427,706 | B1 | * | 9/2008 | Wilhelm | 84/422.4 |
| 7,439,434 | B1 | * | 10/2008 | Cole et al. | 84/422.4 |
| 2004/0244563 | A1 | | 12/2004 | Calato | |
| 2005/0109191 | A1 | * | 5/2005 | Gusek | 84/422.1 |
| 2006/0243118 | A1 | | 11/2006 | Malott | |
| 2008/0168890 | A1 | * | 7/2008 | Judd | 84/422.4 |
| 2009/0000459 | A1 | * | 1/2009 | Lento | 84/422.4 |
| 2009/0000460 | A1 | * | 1/2009 | Lento | 84/422.4 |

OTHER PUBLICATIONS

Paddle Drum with Mallet and Ball, Remo PD-1008-00. A racket type drum. percussion is provided by a mallet or a tennis ball., viewed Nov. 10, 2008 at westmusic.com/ProductDetails.aspx?id=prodid=201062.*

Tennis Ball on a Stick, a teaching of a tennis ball on a stick, the combination used for a meter reader to fend of dogs, blog dated Dec. 18, 2008, viewed Nov. 11, 2008 at www.customjuju.com/index.php/the-tennis-ball-on-a-stick/.*

Tennis Ball Rattle, a teaching to combine a tennis ball and a dowel stick with beans to make a rattle, viewed Nov. 10, 2008 at www.geocities.com/EnchantedForest/Cottage/2727/gscraftpage.html?200810.*

Drummer Boy, Larry Womack, a childhood memoir of the drummer, now 70, recalls that his father formed a makeshift drum maul of a tennis ball on a stick, p. 2, viewed Nov. 11, 2008 at larrywomack.com/Drummer_Boy.htm and /index.htm.*

Benjamin, Patricia J., Massage Rollers and Muscle Beaters, discussion of a pneumatic muscle beater, pp. 3-4, © 2001 American Massage Therapy Association, viewed Mar. 4, 2009 at http://www.amtamassage.org/journal/alookback_fall01.html.*

* cited by examiner

STRIKING MEMBER FOR USE WITH A PERCUSSION INSTRUMENT

CROSS-REFERENCE TO RELATED APPLICATION

This application claims the benefit of U.S. Provisional Patent Application Ser. No. 60/929,453, filed Jun. 28, 2007.

BACKGROUND OF THE INVENTION

1. Field of the Invention

The present invention relates to drum sticks, drum mallets and other striking members for percussion instruments. Particularly, a head formed from a hollow shell is provided, allowing for the head to bounce or flex when struck against a surface, such as a drum, in order to provide enhanced striking characteristics, improve the user's speed and provide for enhanced rhythmic articulations.

2. Description of the Related Art

Drums and striking members for drums (typically in the form of drum sticks and mallets, for example) are well known in the art. Drum sticks and mallets are generally unitary, solid bodies, including a stick portion and a head portion. Drummers often wish to vary the technical or grip-related qualities of their drumming, but drum sticks and mallets typically do not allow for variation in usage, for rebounding, etc. Any variation typically takes place in the drum itself, such as through the tightening of the drum skin, for example.

It would be desirable to allow for variation in the technical or gripping qualities of drumming, which rely on variations in the striking member. Further, typical drum sticks or mallets are solid, unitary units, not allowing for the head to flex or bend. It would be desirable to provide a drum stick or drum mallet, which allows for the head to bounce, flex and rebound upon striking the drum. Thus, a striking member for use with a percussion instrument solving the aforementioned problems is desired.

SUMMARY OF THE INVENTION

The striking member for use with a percussion instrument is a flexible and moveable variation of a conventional unitary or one-piece drum stick, drum mallet or the like, further providing a head which bounces, flexes and/or rebounds upon striking the drum. The induced moveable vibration and flexing in the head of the striking member generates enhanced striking characteristics, particularly in comparison to conventional, unitary, solid drum sticks and the like, and further allows the user to articulate rhythms utilizing the additional flexure or bouncing of the head, and further enhances the user's striking speed and provides lesser strain on the user's hands and feet (as will be described in greater detail below). The added flexible characteristics further provide an enhanced balancing effect for the drummer. This technology yields a balance to the drumstick or mallet, helping to distribute the weight of the striking member along its axis. This balancing effect will be felt, primarily, in the user's grip. As will described in greater detail below, this technology may be encapsulated within a variety of materials such as nylon, wood, resin or felt, for example, or used as a "stand-alone" embodiment.

The usage of such a drum stick, mallet or beater (a "beater" is the common term for a foot operated mallet, generally associated with bass drum pedals) having flexible characteristics in either the head or along the stick portion, allows for reduction of hand fatigue, enables the drummer or percussionist to actuate rhythms with greater bounce, and further reduces the need to apply as much pressure to a fulcrum area or point in the hand of the user. Preferably, a multiplicity of such sticks or mallets are provided (or a multiplicity of interchangeable heads, as will be described below) such a performer can choose a particular embodiment or alternative configuration that fits his or her needs.

As will be described in greater detail below, the head of the stick or mallet may be removable and replaceable (via threaded interconnection or the like). These embodiments provide an alternate means for performers who use specialty sticks, and who may wish to replace the conventional tips of the drum sticks with the flexing heads described herein.

The striking member includes a stick having longitudinally opposed first and second ends, and a head formed as a hollow shell. The hollow shell has an upper end and a lower end, with the lower end having an opening formed therethrough. The first end of the stick is adapted for grasping by the user, and the second end is inserted through the opening, into an open interior region of the hollow shell. The hollow shell is secured to the stick, and vibrates when striking a surface, such as a drum, for example. As will be described in further detail below, an annular lip or ring may be formed on the stick, or on a separate support member, allowing for flexible joining of the hollow shell to the stick.

An elastic material may further be received within the hollow shell, and may at least partially fill the open interior region thereof, in order to provide damping for the vibration of the shell. The elastic material may be a polymer material, urethane, polyurethane, silicone, polyvinyl chloride, acetate, styrene, polystyrene, rubber, cork, rubberized cork, nylon, resin, wood, aluminum, plastic, felt, yarn, string, silicone gel, metal, and combinations thereof, or any other desired elastic material, dependent upon the particular needs and desires of the user.

Alternatively, a support member having longitudinally opposed upper and lower ends may further be provided. The lower end of the support member is secured to the second end of the stick, and the upper end of the support member is inserted within the hollow shell, rather than the second end of the stick being inserted therein, as described above. The support member may be releasably secured to the second end of the stick, allowing for efficient removal and replacement of the support member or the hollow shell.

As a further alternative, a sheath may be provided for covering the upper end of the support member, with the sheath being formed from elastic material, in order to induce further flexure characteristics in the head of the striking member. The sheath may be formed from a polymer material, urethane, polyurethane, silicone, polyvinyl chloride, acetate, styrene, polystyrene, rubber, cork, rubberized cork, nylon, resin, wood, aluminum, plastic, felt, yarn, string, silicone gel, metal, and combinations thereof, or any other desired elastic material, dependent upon the particular needs and desires of the user. Further, a lip or ring (similar to the annular ring, described in greater detail below) may be added to the support member, allowing for further elastic variation in the joining and attachment of the striking member head.

As a further alternative, an annular ring may be provided for mounting on the lower end of the hollow shell, about the opening formed therethrough. The annular ring is formed from elastic material, similar to that described above with regard to the material received within the hollow shell, in order to provide additional vibrational and flexure characteristics for the head of the striking member. The annular ring may be mounted separately on either the stick or the support member, or may formed as a permanent lip about either the stick or the support member, providing for flexible joining of the stick to the head.

Additionally, it should be understood that the hollow shell, formed of nylon or the like, dependent upon the particular needs and desires of the user, may be replaced by a head formed purely of elastic material, acting as a stand-alone attachment to the stick, dependent upon the particular needs and desires of the user.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
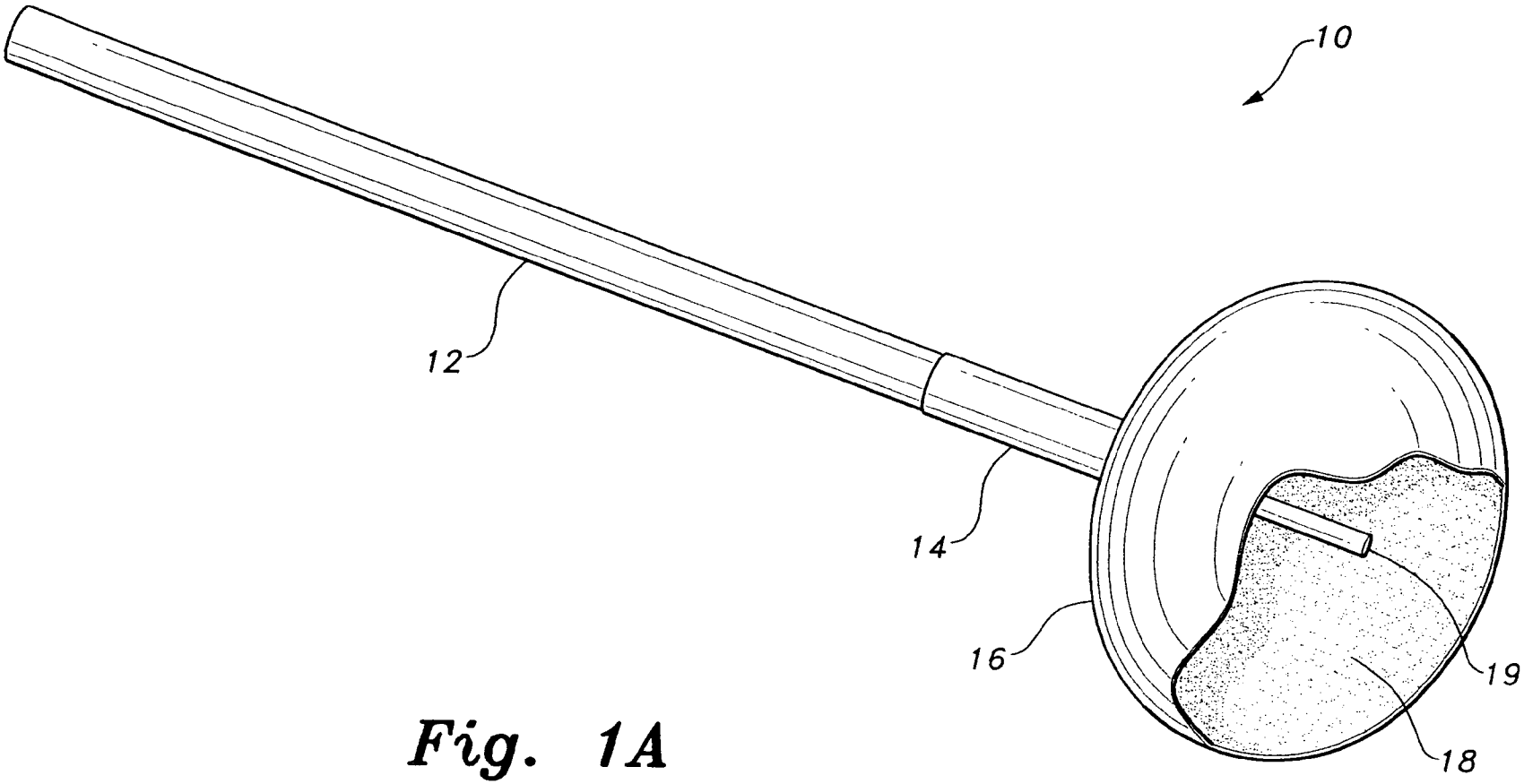
FIG. 1A is a partially cut-away, perspective view of a striking member for use with a percussion instrument according to the present invention.
Figure 1B:
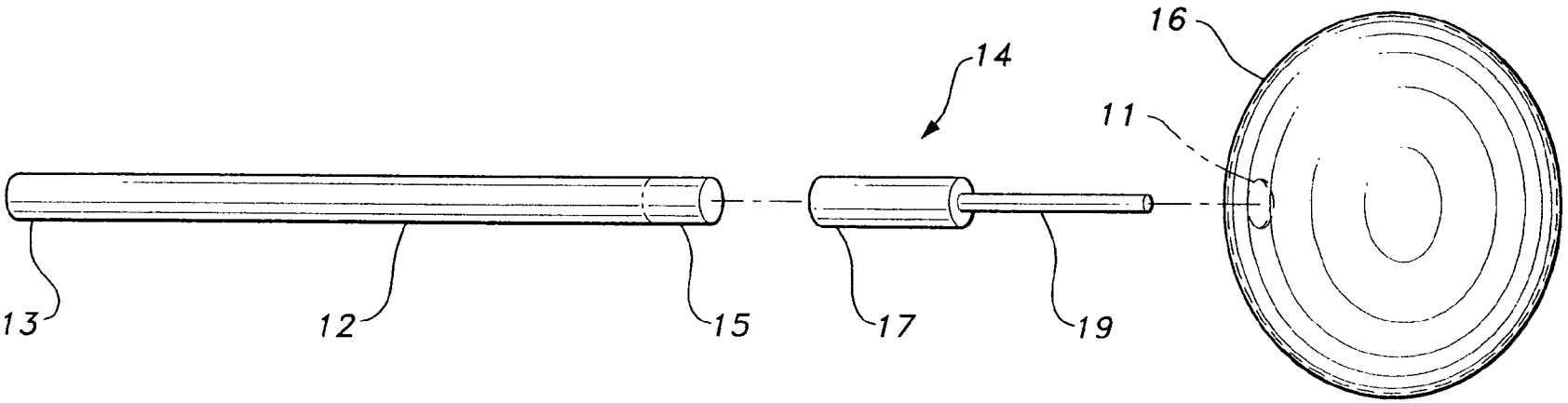
FIG. 1B is an exploded view of the striking member for use with a percussion instrument according to the present invention.

The present invention is directed towards a striking member for use with a percussion instrument. The striking member is a vibration-inducing variation of a conventional unitary or one-piece drum stick, drum mallet or the like, further providing a head which bounces, flexes and/or rebounds upon striking the drum. FIGS. 1A and 1B illustrate a first embodiment of the striking member 10, formed as a mallet for drums, though it should be understood that the drum mallet configuration is shown for exemplary purposes only, and that the striking member 10 may be configured for use with any type of percussion instrument.

The induced vibration and flexure in the head of the striking member 10 generates enhanced acoustic, striking and rhythmic characteristics, particularly in comparison to conventional, unitary, solid drum sticks and the like, and further allows the user to articulate rhythms with enhanced bounce and/or rebounding through the flexure of the head.

The usage of such a drum stick, mallet or beater (a "beater" is the common term for a foot operated mallet, generally associated with bass drum pedals) having flexible characteristics in either the head or along the stick portion, allows for reduction of hand fatigue, enables the drummer or percussionist to actuate rhythms with greater bounce, and further reduces the need to apply as much pressure to a fulcrum area or point in the hand of the user. Preferably, a multiplicity of such sticks or mallets are provided (or a multiplicity of interchangeable heads, as will be described below) such a performer can choose a particular embodiment or alternative configuration that fits his or her needs.

As will be described in greater detail below, the head of the stick or mallet may be removable and replaceable (via threaded interconnection or the like). These embodiments provide an alternate means for performers who use specialty sticks, and who may wish to replace the conventional tips of the drum sticks with the flexing heads described herein. Alternatively, the striking members may be formed as integral or monolithic units.

The striking member 10, as shown in FIGS. 1A and 1B, includes a stick 12 having longitudinally opposed first and second ends 13, 15, respectively, and a head formed as a hollow shell 16. The hollow shell 16 has an upper end and a lower end, with the lower end having an opening 11 formed therethrough. It should be understood that the depth of penetration of the stick within the hollow shell may be varied dependent upon the particular needs and desires of the user (including no penetration, with the stick being secured only to the outer surface of the shell). It should be understood that stick 12 may be a conventional drumstick, and that shell 16 is provided as an add-on to the drumstick. Alternatively, stick 12 may simply be a shaft, as illustrated.

The first end 13 of the stick 12 is adapted for grasping by the user, and the second end 15 may either be directly inserted through the opening 11 (as will be described in greater detail below), to extend within an open interior region of the hollow shell 16, or, as shown, may be joined to a support member 14, which will also be described in greater detail below. The hollow shell 16 is secured to the stick through any suitable means of attachment, dependent upon the particular needs and desires of the user, and vibrates when striking a surface, such as a drum, for example. The hollow shell 16 acts as a resonance cavity, vibrating to create additional acoustic effects upon striking the drum surface. The resonant frequency of the hollow shell 16 may be varied through varying the size, shape and materials of formation of the hollow shell 16.

Though shown as having a substantially spherical shape in FIGS. 1A and 1B, it should be understood that the hollow shell 16 may have any desired size or shape (or materials of construction), dependent upon the desired acoustic effects and flexure-related properties associated therewith. The hollow shell 16 could have, for example, an ellipsoidal contour.

Preferably, a wide variety of striking members 10, having a wide variety of shapes and sizes, are provided such that the user may create a variety of acoustic effects with a single drum. Further, the hollow shell 16 may have any desired thickness, dependent upon the particular acoustic characteristics sought by the user. For example, the hollow shell may only have a relatively thin thickness, along the order of 1 mm, or may fill a large percentage of the interior volume of the head.

The stick 12 and hollow shell 16 may be formed from any suitable materials, dependent upon the particular needs and desires of the user. For example, the stick 12 and shell 16 may be formed from nylon, wood, resin, aluminum, or any other suitable material. Hollow shell 16 may further be formed from rubber, plastic, string, felt, yarn, or any other suitable material. Stick 12 and hollow shell 16 may be sized and shaped dependent upon the particular needs and desires of the user. Conventional drum mallets typically have a length of between approximately 13 inches and 18 inches, and may weigh between approximately 36 grams and 80 grams.

An elastic material 18 may further be received within the hollow shell 16, and may at least partially fill the open interior region thereof, in order to provide damping for the vibration of the shell 16, thus providing further variation in resonant frequency and acoustic effects. The elastic material 18 may be a polymer material, urethane, polyurethane, silicone, polyvinyl chloride, acetate, styrene, polystyrene, rubber, cork, rubberized cork, nylon, resin, wood, aluminum, plastic, felt, yarn, string, silicone gel, metal, and combinations thereof, or any other desired elastic material, dependent upon the particular needs and desires of the user. As an additional alternative, a plurality of shells may be provided, with the shells having decreasing radii or sizes, and being formed substantially concentrically with respect to one another. Such shells may be used in combination with any of the alternative embodiments described herein.

As noted above, and as shown in FIGS. 1A and 1B, a support member 14 having longitudinally opposed upper and lower ends 19, 17, respectively, may further be provided. The lower end 17 of the support member 14 is secured to the second end 15 of the stick 12, and the upper end 19 of the support member 14 is inserted within the hollow shell 16, rather than the second end 15 of the stick 12 being inserted directly therein, as described above.

The support member 14 may be releasably secured to the second end 15 of the stick 12, allowing for efficient removal and replacement of the support member 14 or the hollow shell 16. The lower end 17 of the support member 14 may be secured to the second end 15 of stick 12 through use of any suitable means for attachment, dependent upon the particular needs and desires of the user. For example, the support member 14 may be releasably joined to the second end through a threaded connection, or may, for example, be permanently mounted thereon through use of adhesives, connectors or the like. As a further alternative, a plurality of shells may be provided, with the shells being mounted on the stick or separate supports (to be described in greater detail below) substantially concentrically.

Figure 3:
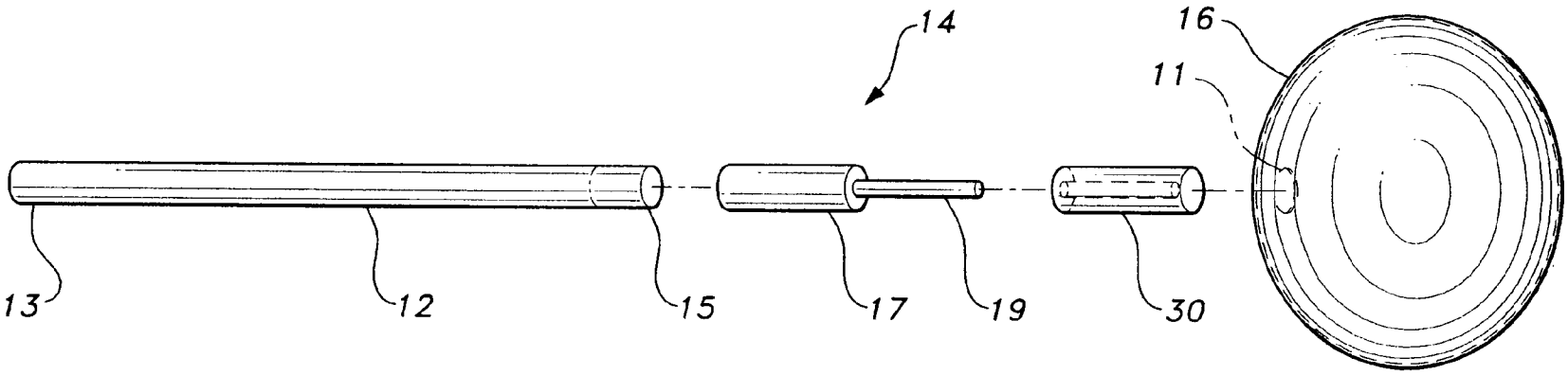
FIG. 3 is an exploded view of an alternative embodiment of the striking member for use with a percussion instrument according to the present invention.

Alternatively, as shown in FIG. 3, a sheath or sleeve 30 may be provided for covering the upper end 19 of the support member 14, with the sheath or sleeve 30 being formed from an elastic material, in order to induce further vibrational characteristics in the head of the striking member. The sheath or sleeve 30 may be formed from a polymer material, urethane, polyurethane, silicone, polyvinyl chloride, acetate, styrene, polystyrene, rubber, cork, rubberized cork, nylon, resin, wood, aluminum, plastic, felt, yarn, string, silicone gel, metal, combinations thereof, or any other desired elastic material, dependent upon the particular needs and desires of the user. The sleeve 30 (or the second end of the stick or upper end of the support member, in the alternative embodiments) may extend any desired distance within the hollow shell 16, dependent upon the particular needs and desires of the user, and dependent upon the desired acoustic and flexure characteristics of the striking member. Sleeve 30 may further include a coil spring positioned either exterior or interiorly thereto.

Figure 6:
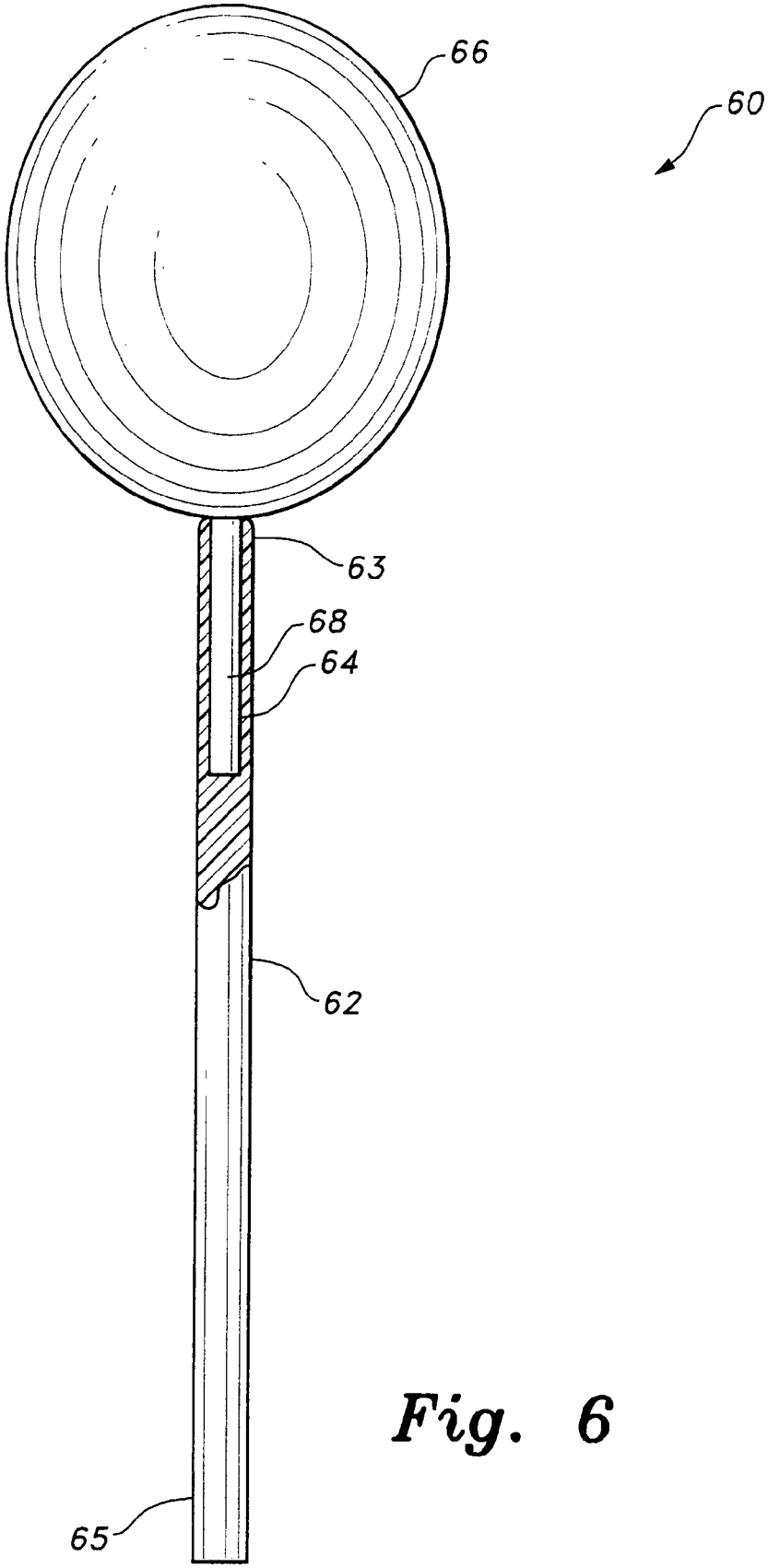
FIG. 6 is a partial cross-sectional view of an alternative embodiment of the striking member for use with a percussion instrument according to the present invention.

In the alternative embodiment illustrated in FIG. 6, the striking member 60 includes a stick 62, similar to stick 12 of FIGS. 1A and 1B, having a lower end 65, adapted for grasping by the user, and an upper end 63. The upper end 63 has a recess 64 formed therein, for receiving a support member 68. The upper end of support member is fixed to the lower end of hollow shell 66, and support 68 is secured within recess 64. Support 68 may be held within recess 64 through frictional engagement therewith, or through the use of additional means for attachment, dependent upon the particular needs and desires of the user.

Figure 2:
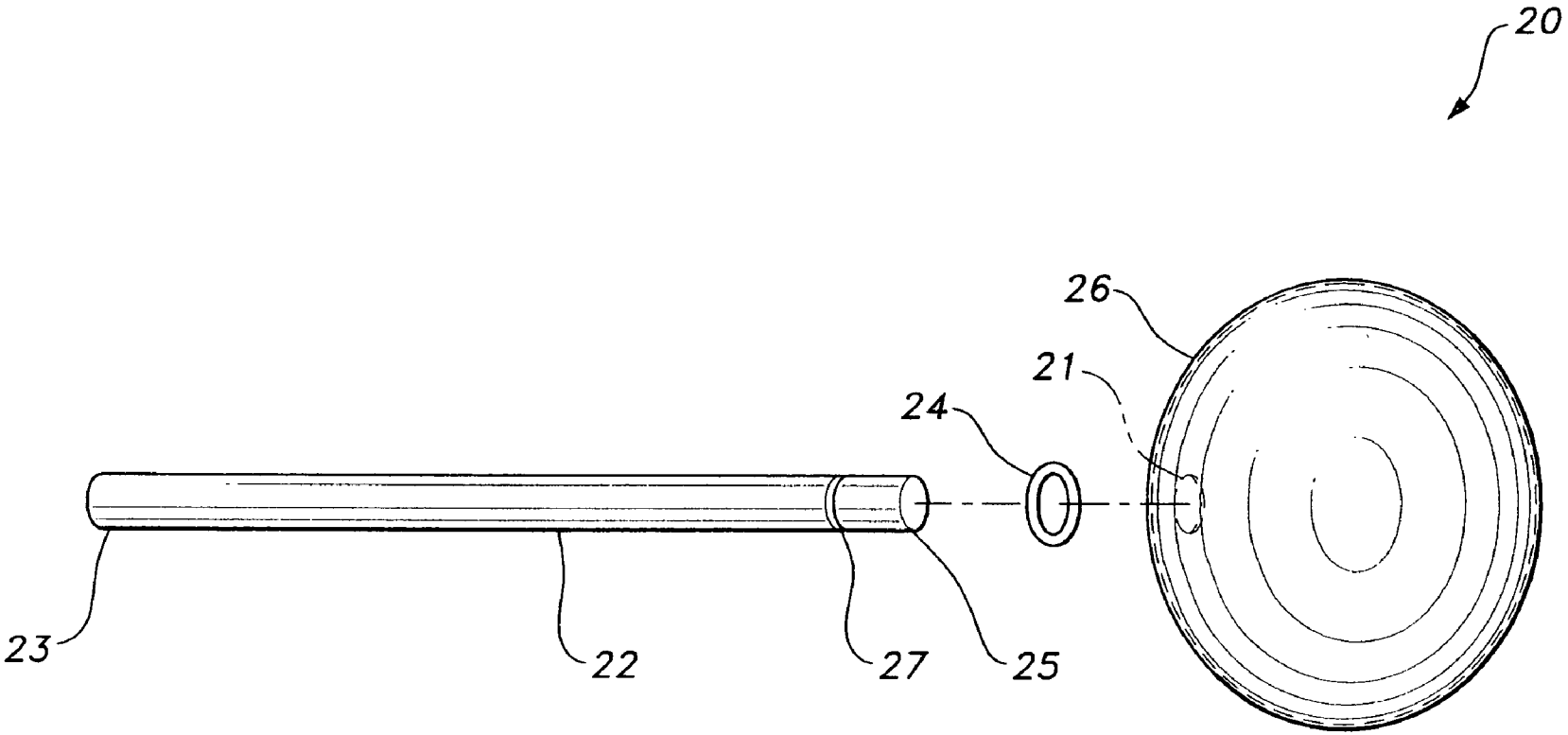
FIG. 2 is an exploded view of an alternative embodiment of the striking member for use with a percussion instrument according to the present invention.

Further, as shown in the alternative embodiment of FIG. 2, an annular ring 24 may be added to the striking member 20, which functions in a manner similar to striking member 10 of FIGS. 1A and 1B. As shown in FIG. 2, the annular ring 24 is mounted on the lower end of the hollow shell 26, about the opening 21 formed therethrough. The annular ring 24 is formed from elastic material, similar to that described above with regard to the elastic material received within the hollow shell, in order to provide additional vibrational and flexure characteristics for the head of the striking member 20. Similar to the embodiments of FIGS. 1A, 1B and 3, the striking member 20 includes a stick 22, having a first end 23, adapted for grasping by the user, and a second end 25. As noted above with reference to FIGS. 1A and 1B, the second end of the stick may be inserted directly within the hollow shell, dependent upon the particular needs and desires of the user. Such is the case in the embodiment of FIG. 2, with second end 25 being inserted directly into hollow shell 26, through opening 21. Alternatively, the annular ring may be formed as a lip or ring on the support member described above, rather than being a separate element joined to the lower end of the hollow shell. The annular ring may be mounted separately on either the stick or the support member, or may formed as a permanent lip about either the stick or the support member, providing for flexible joining of the stick to the head. In the alternative, annular ring 24 may further be replaced or augmented by a flexible or elastic sleeve, similar to that described above with regard to FIG. 3.

Further, an annular groove 27 is formed in the outer surface of stick 22, adjacent the second end 25. The circumferential edge defining opening 21, and the inner circumferential edge of annular ring 24, are received within groove 27, to secure the hollow shell 26 to the stick 22. Further means of attachment, such as adhesives or the like, may also be added, dependent upon the particular needs and desires of the user. Additionally, the hollow shell 26 may be at least partially filled with elastic material, as described above with reference to the embodiment of FIGS. 1A and 1B.

Figure 4:
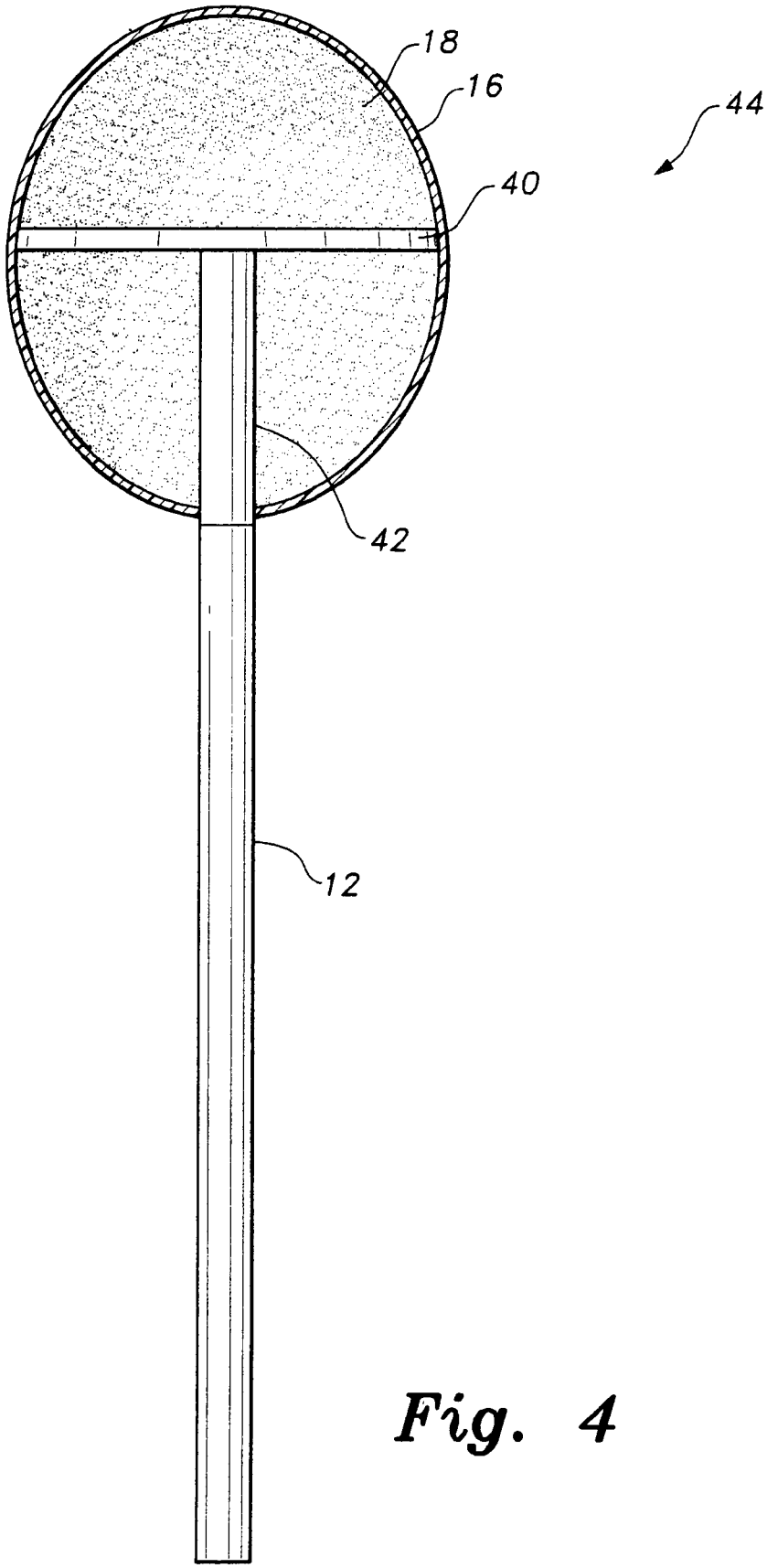
FIG. 4 is a partial cross-sectional view of an alternative embodiment of the striking member for use with a percussion instrument according to the present invention.

In the embodiment illustrated in FIG. 4, the striking member 44 includes a stick 12, a hollow shell 16, and elastic material 18. Support 14 of the embodiment of FIGS. 1A and 1B has been replaced by a support 42, which has a disc or plate 40 formed on the upper end thereof. The disc or plate 40 preferably contacts the inner surface of hollow shell 16, as shown, in order to vary the resonant frequency and flexure characteristics thereof and provide for further variation in the striking characteristics caused thereby when struck against a drum. Although shown as having only a single disc or plate 40, it should be understood that multiple such plates may be mounted on support 42, allowing for variation in the vibrational and flexure characteristics of the head. It should be understood that in FIG. 4, the plate 40 and sleeve 42 are shown encapsulated within the elastic material 18, however, these elements may also be utilized in a "stand-alone" embodiment; i.e., without encapsulation within the elastic material.

Figure 5:
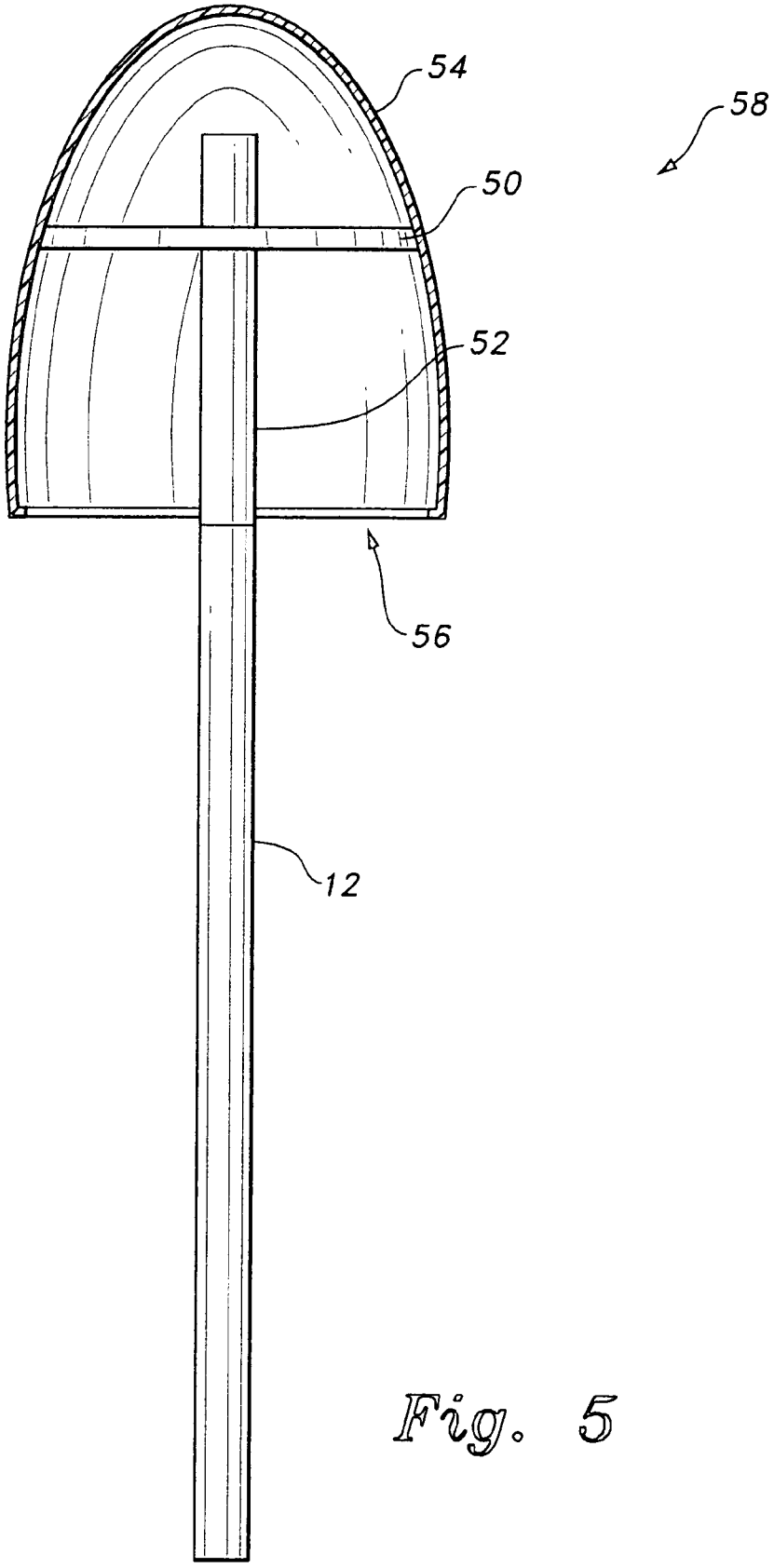
FIG. 5 is a partial cross-sectional view of an alternative embodiment of the striking member for use with a percussion instrument according to the present invention.

In the alternative embodiment shown in FIG. 5, the striking member 58 includes stick 12 and a support 52. A plate or disc 50 is provided, similar to that shown in the embodiment of FIG. 4, however the plate or disc 50 is mounted on a central region of support 52, rather than on the upper end, as shown. The variation in placement of plate or disc 50 provides for varied acoustic effects, and the positioning of the plate or disc 50 is dependent upon the particular needs and desires of the user.

Further, as noted above, the shape and size of the hollow shell may be varied, dependent upon the particular needs and desires of the user. In the embodiment of FIG. 5, shell 54 has a substantially parabolic or bell-like shape, with the lower end 56 being open, as shown. It should be understood that the variations shown in the various embodiments of the present invention may be combined, dependent upon the particular needs and desires of the user.

Figure 11:
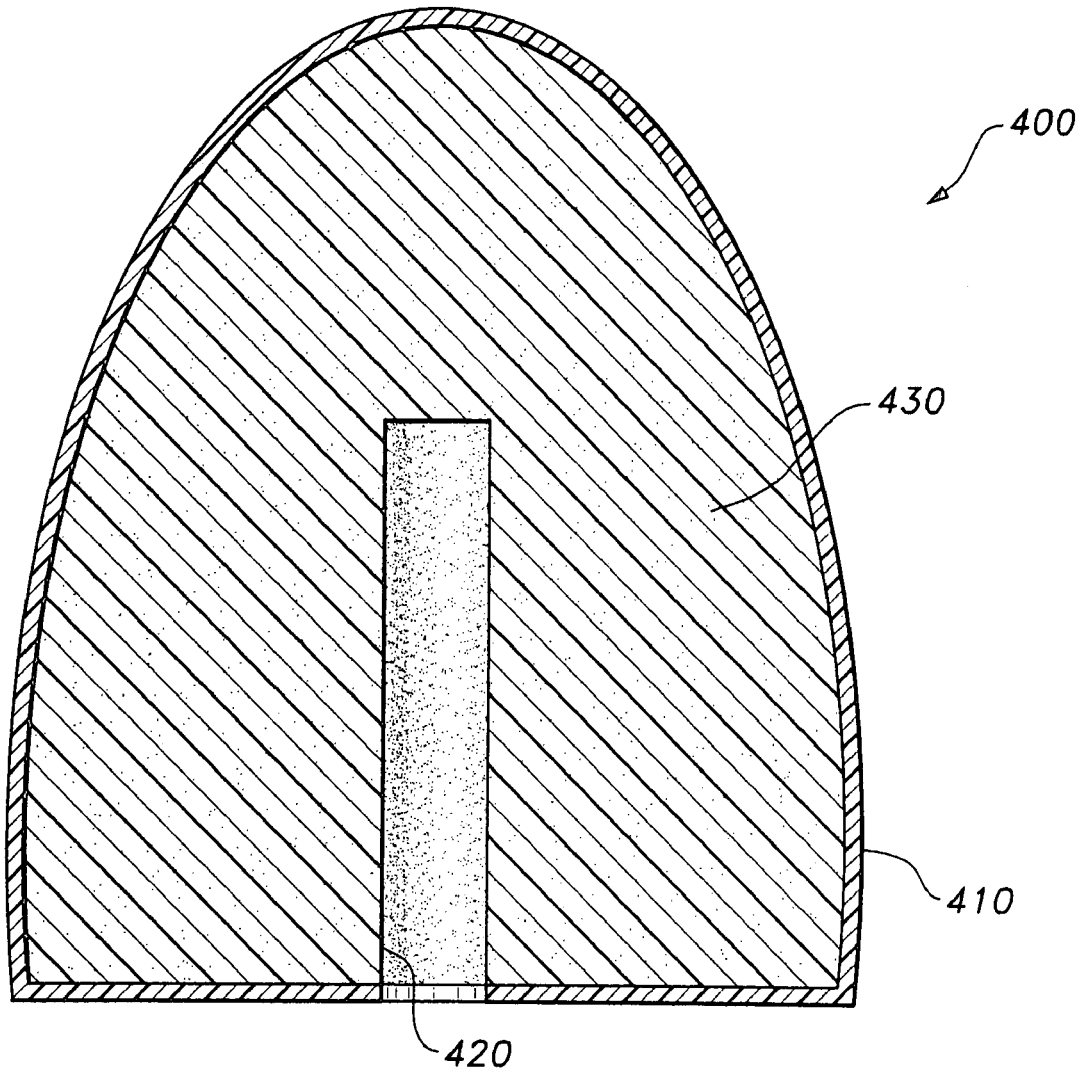
FIG. 11 is a cross-sectional side view of a head for an alternative embodiment of the striking member for use with a percussion instrument according to the present invention.

Alternatively, as shown in FIG. 11, the parabolic head may be formed as a filled body, rather than as a hollow body, as shown in FIG. 5, with head 400 including a central inner sleeve or support 420 (as described above), mounted within elastic material 430 (as described above). An exterior surface of elastic material 430 may form the exterior surface of head 400, or an outer shell 410 (as described above) may be provided. It should be understood that the parabolic shape of FIGS. 5 and 11 is shown for exemplary purposes only, and that the heads for the striking members may have any desired shape or contour, dependent upon the particular needs and desires of the user.

Figure 7:
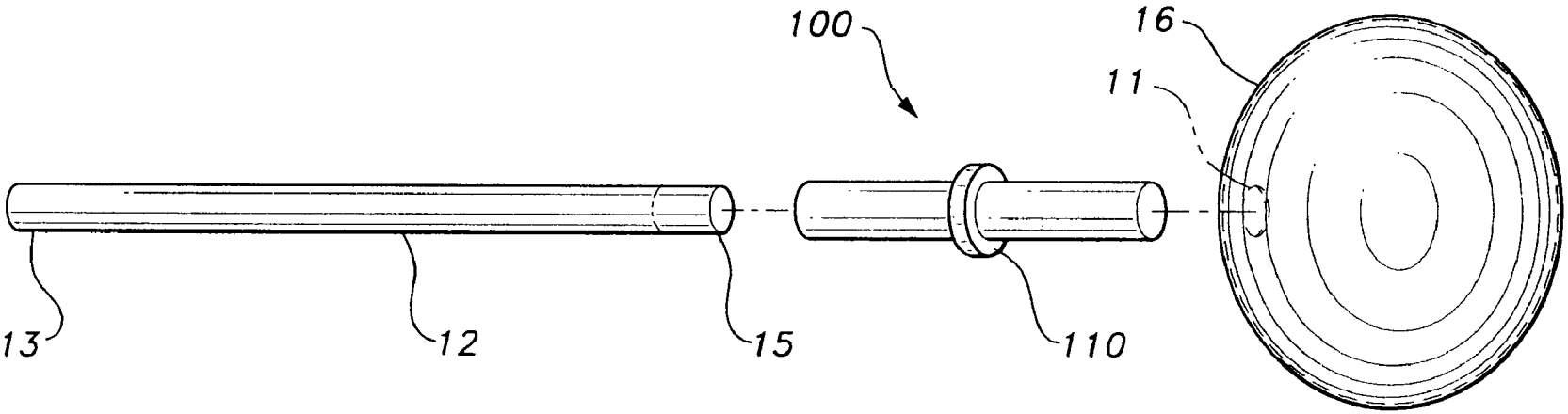
FIG. 7 is an exploded perspective view of an alternative embodiment of the striking member for use with a percussion instrument according to the present invention.

In the alternative embodiment of FIG. 7, the support member 14 of the embodiment of FIG. 3 is replaced by a support member 100, which is similarly formed from flexible and elastic materials, as described above. Such elastic materials include, but are not limited to, urethane, polyurethane, silicone, polyvinyl chloride, acetate, styrene, polystyrene, rubber, cork, rubberized cork, nylon, resin, wood, aluminum, plastic, felt, yarn, string, a spring, metal, and silicone gel. Support member 100 may either be a solid or hollow cylindrical member, and includes an annular lip or ring 110 formed thereon. Lip or ring 110 is similar in function to annulus 24 of FIG. 2, but is formed integrally on support member 100. Lip or ring 110 may be positioned anywhere along the length of support 100, dependent upon the particular needs and desires of the user. When fully constructed, the lower end of hollow shell 16 sits on, and is supported by, lip or ring 110. The lip or ring 110 is formed of flexible and elastic material, as described above. As a further alternative, the support member 100 may be formed as a sleeve, or may include a plurality of interlocking members, allowing for variation in length and, thus, elastic properties. As noted above, the support may form a hollow sleeve, preferably flexible. As an alternative to providing an integral ring or disc, the sleeve may be scored, such that a separate annular ring (such as that shown in FIG. 2) may be mounted on the score or groove. Further, as noted above, the lip may be formed anywhere along the length of the support, including both the top and bottom edges thereof. Additionally, as noted above, the support may be formed as a plurality of interlocking pieces, and may further be formed as a hollow sleeve. A plurality of hollow sleeves may be interlocked together for the purposes of providing further or varied flexure, or for solidifying the inner wall of the shell or tip. Preferably, the sleeves are formed from materials softer than the wood or nylon of the head. Preferably, a pair of sleeves are provided, with one being received within the other. The variable positioning of the lip or ring as described above preferably applies to this pair of interlocking sleeves.

Figure 10:
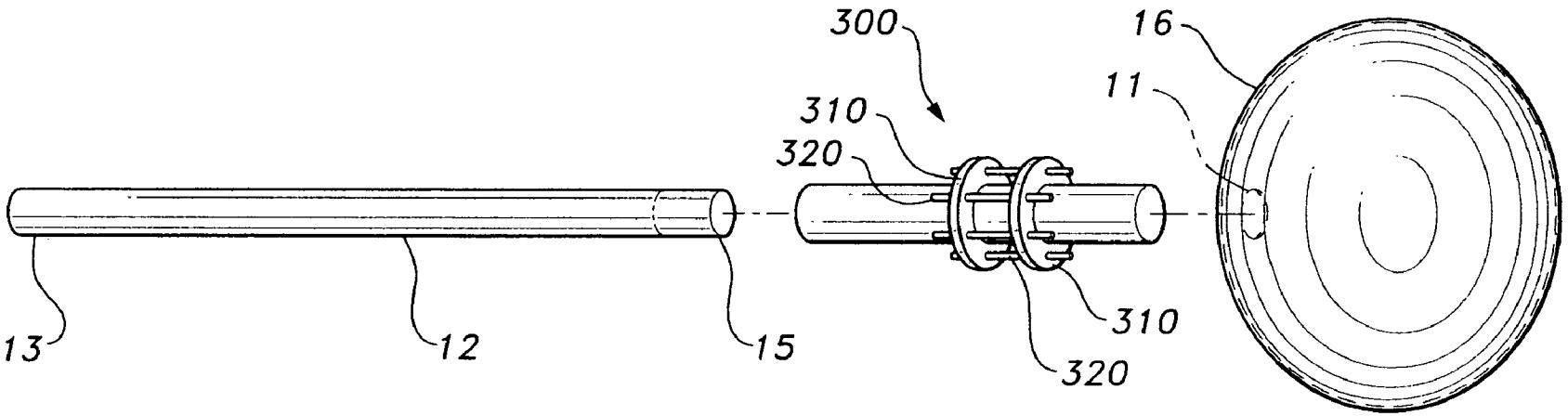
FIG. 10 is an exploded perspective view of an alternative embodiment of the striking member for use with a percussion instrument according to the present invention.

In FIG. 10, the support member 100 of FIG. 7 is replaced by a support member 300, which is formed similarly to that described above, but includes a pair of lips or rings 310, as shown. A plurality of flexing rods 320 are annularly positioned through both lips 310, as shown, and provide for additional elastic properties of the support member, and may also be utilized to secure the support member 300 to the shell 16 (through insertion into complementary apertures formed about opening 11). As a further alternative, elastic material, as described above, may be inserted between the lips 310, dependent upon the particular needs and desires of the user.

Figure 8:
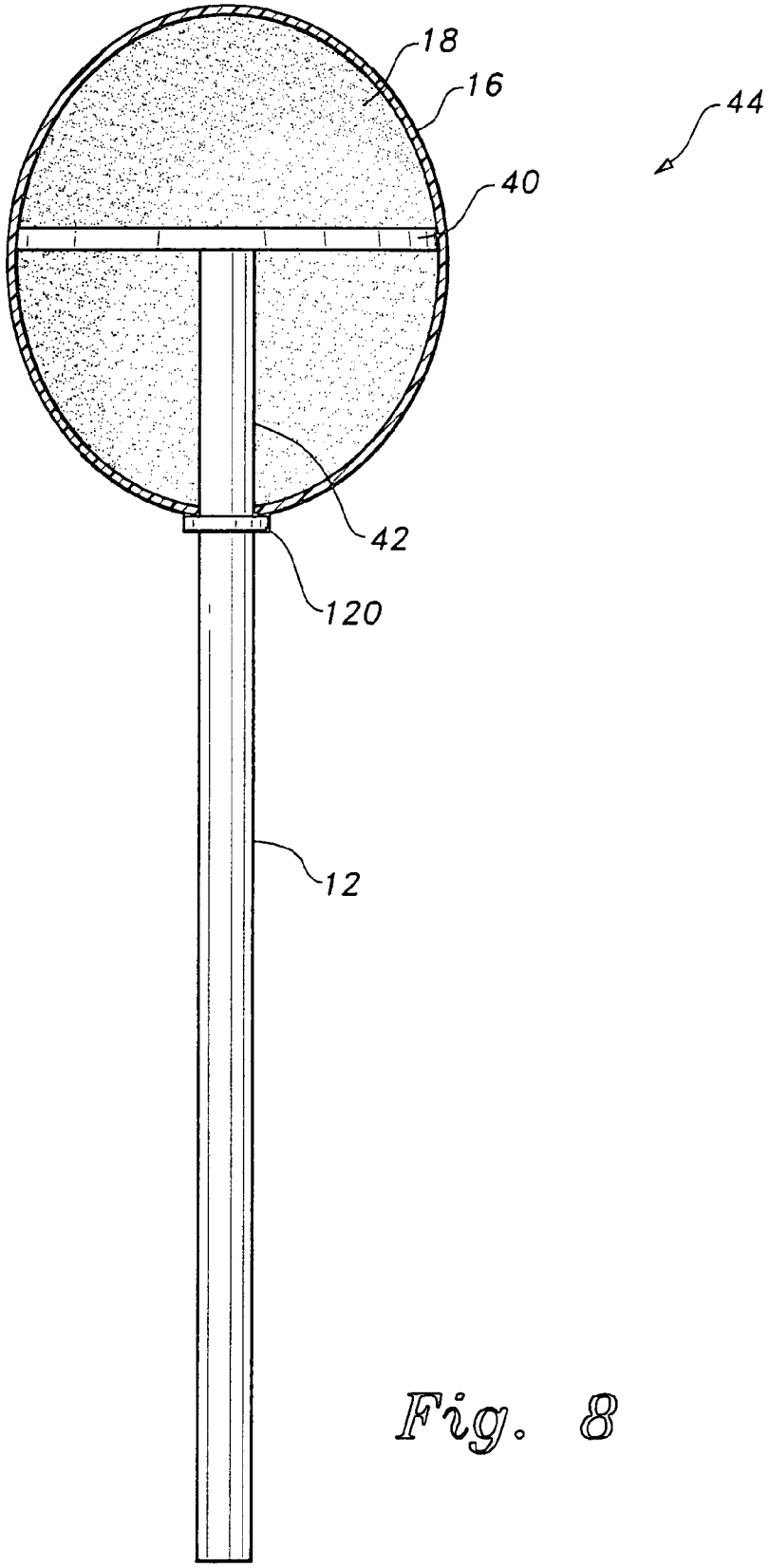
FIG. 8 is a partial cross-sectional view of an alternative embodiment of the striking member for use with a percussion instrument according to the present invention.

Similarly, FIG. 8 illustrates a striking member similar to that shown in FIG. 4, however an annular lip or ring 120 is formed on the lower end of support 42, for interconnection with stick 12, and with the lower end of hollow shell 16 being supported thereon. As with annulus 24, the annular lip or ring is formed from an elastic material, allowing for the flexure of the striking member. As a further alternative, an opening may be formed through the upper portion of the hollow shell, allowing the head of the striking member to be reversed and attached to the stick, thus providing greater variation in the acoustic properties thereof. It should be understood that this reversible head may be applied to any of the embodiments described herein. It should be noted that plate 40 in FIG. 8 is shown for exemplary purposes only. Plate 40 may have any desired radius, may be positioned at any desired height on support 42, and multiple plates 40 may be provided, all dependent upon the particular needs and desires of the user. Further, plates 40 may be mounted directly within the hollow shell, and secured to the inner walls thereof, without being supported on a separate support member. In addition to the elastic material described above for filling shell 16, a coil spring or other elastic member may further be mounted within shell, or may be mounted on plate 40.

Figure 12:
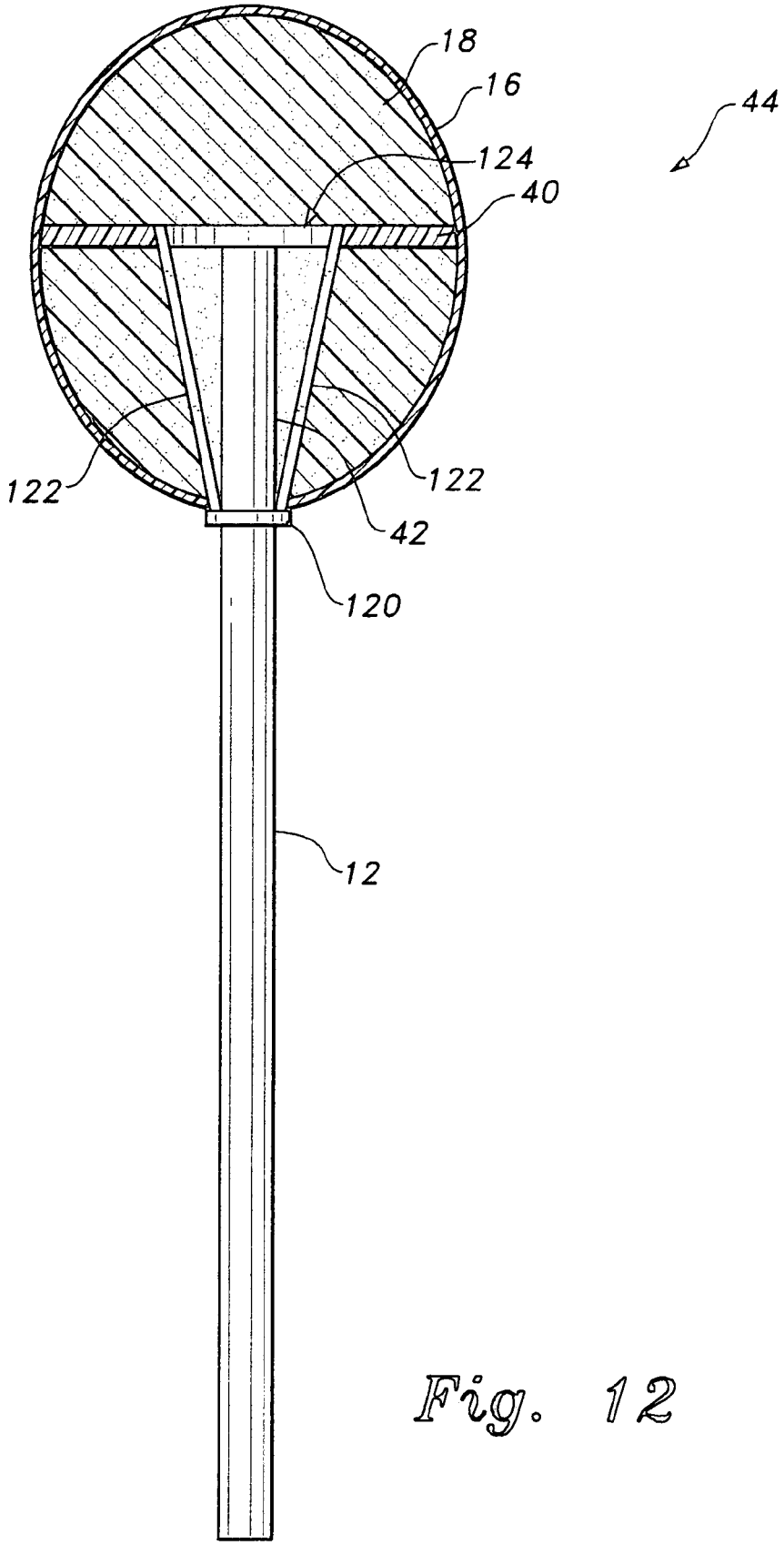
FIG. 12 is a partial cross-sectional view of an alternative embodiment of the striking member for use with a percussion instrument according to the present invention.

In FIG. 12, a plurality of expandable members 122 are joined to support 42, which act to press against plate 40, thus securing it within shell 16. The expandable members 122 pass through a central opening 124 and elastically bear thereagainst. Elastic members 122 act to further provide variation in the elastic properties of the head of the striking member.

Figure 9:
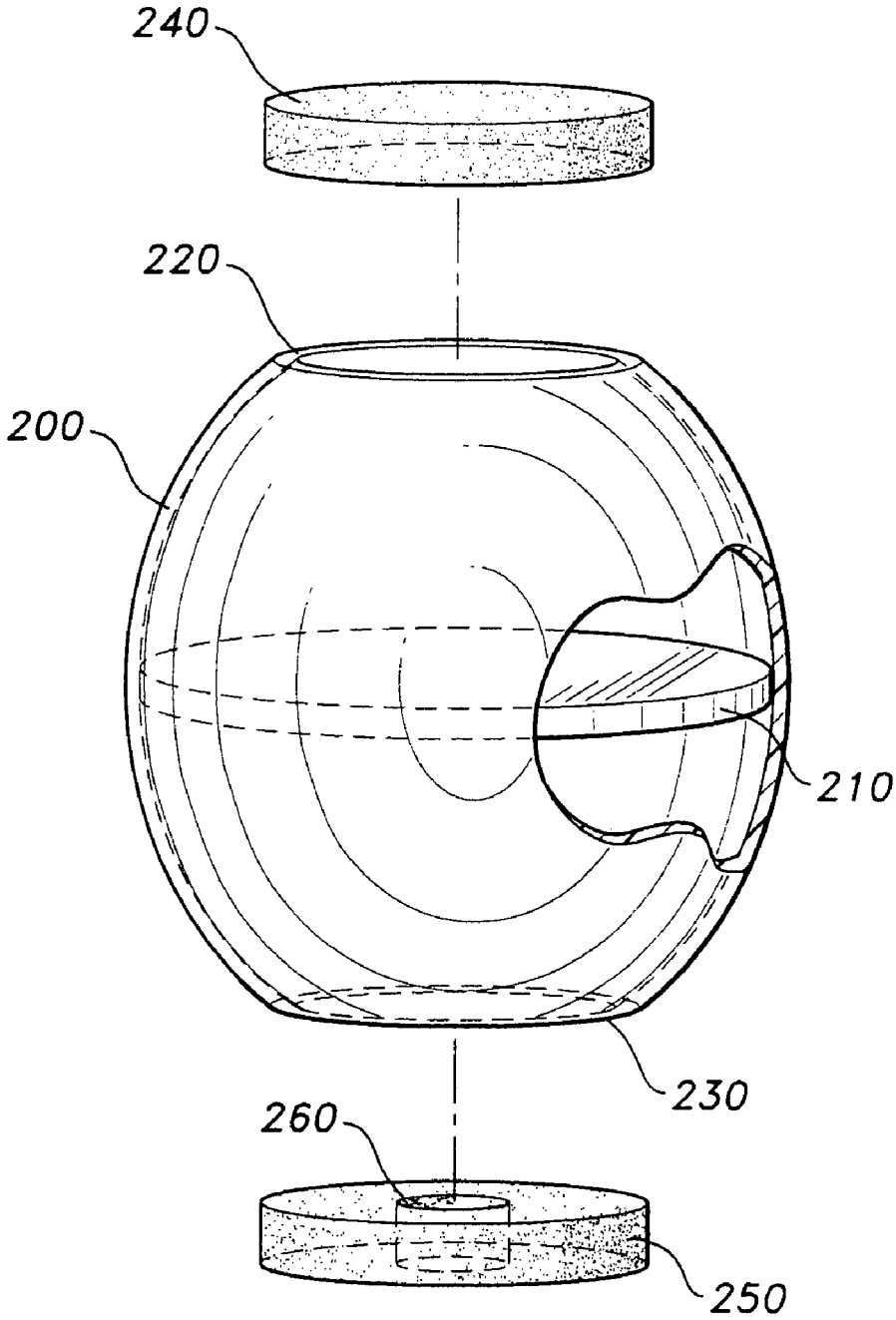
FIG. 9 is an attachment view of a head for an alternative embodiment of the striking member for use with a percussion instrument according to the present invention.

In FIG. 9, the head of the mallet or other striking instrument is formed from a hollow shell 200 having an inner plate 210 (similar to plate 40 of FIG. 8), and further having open upper and lower ends 220, 230, respectively. Elastic material (such as elastic material 18, described above) may be inserted through the open ends 220, 230. The upper end is sealed by a cap member 240, and the lower end is sealed by a cap member 260. The caps may be secured to the upper and lower ends through any suitable means of attachment, or may be formed as plugs, with the plugs being secured within the open ends through frictional engagement therewith. The lower cap 250 includes a central opening 260 to receive the shaft of the striking member. It should be understood that the fillable head of FIG. 9 may be utilized in combination with any of the embodiments described above. Further, the user may fill the head with any desired elastic material, or any desired combination of elastic materials, to any desired volume, thus allowing for user-controllable variation in the elastic properties of the head.

Figure 13:
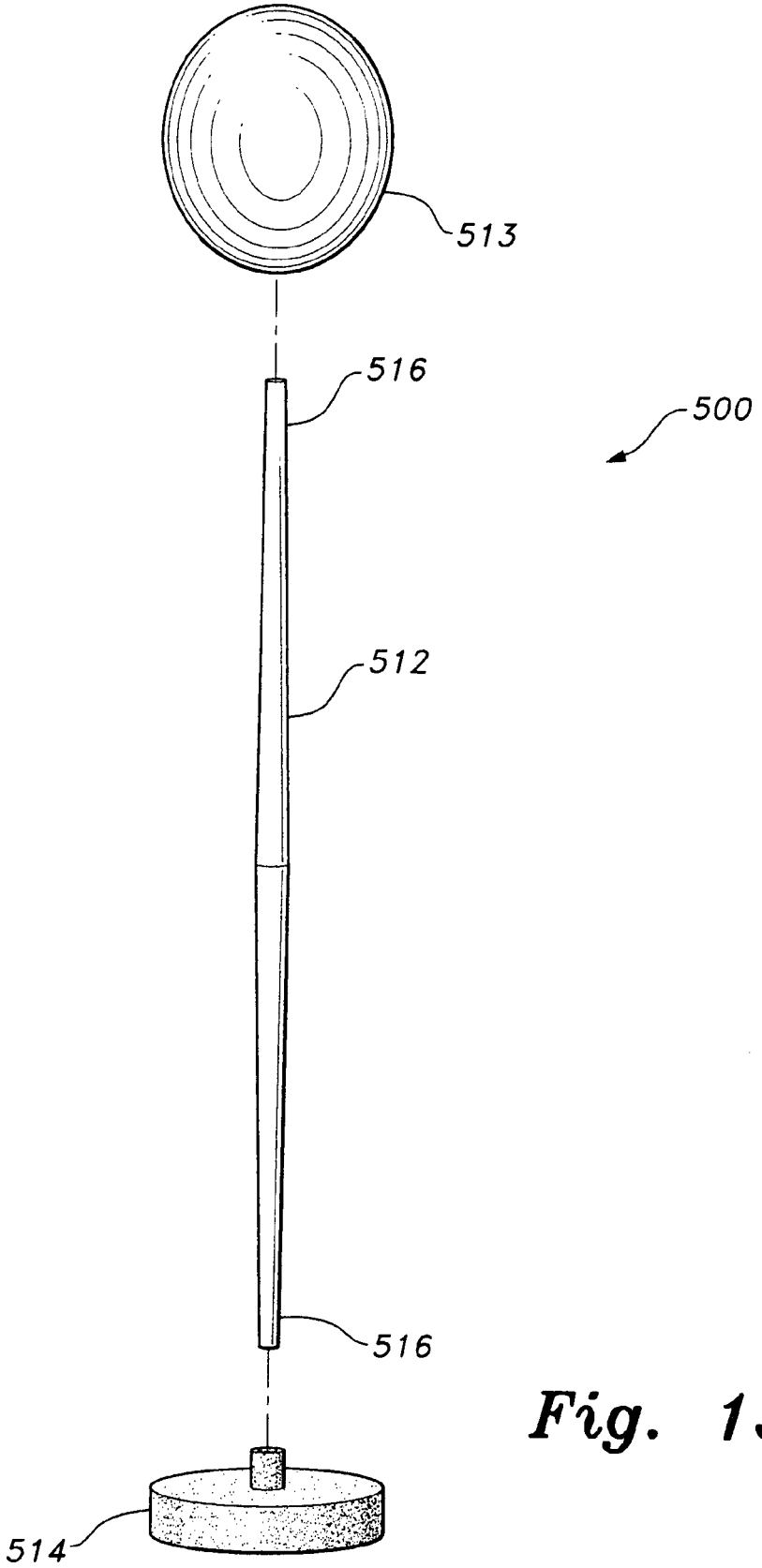
FIG. 13 is a side, attachment view of an alternative embodiment of the striking member for use with a percussion instrument according to the present invention.

As described above, the heads of the various embodiments of the striking member are preferably removable and interchangeable. As shown in FIG. 13, the striking member 500 includes a pair of separate heads 513, 514 mounted to stick 512. Heads 513 and 514 are shown for exemplary purposes only and may have any size, contouring or structure as described above in various embodiments of the present invention. Heads 513 and 514 are shown as being dissimilar in construction such that the user may use one head, and then reverse his or her grip on the stick 512 to use the other head. Stick 512 is preferably symmetric, as shown, and may include tapered ends 516 for easier insertion and/or connection to heads 513, 514. As described above, the heads 513, 514 may be joined to the stick 512 through threaded connections, through frictional engagement therewith or through any other means of attachment. The striking member 500 may alternatively be formed as a one-piece, integral member, as described above.

The above striking members may be manufactured and formed through any conventional process or method. Such methods may include manual/computerized lathes, molds, dyes, templates, sonic welding, or any other means of manufacturing that are readily available, or methods to be implemented by using new technology if applicable.

All flexing tips, etc. in any and all of the above embodiments, along with drumsticks/mallets that are designed specifically for the present invention, will act integrally and separately as per the intended and desired use of this invention and the desired manufacturing needs. Sticks/mallets may contain scores/rings, channeled/vertical grooves for interlocking, or any other types of securement techniques, and may be manufactured via manual/computerized lathes, molds, dyes, templates, sonic welding, or any other means of manufacturing that are readily available, or methods to be implemented by using new technology if applicable, as that of all flexing tips, and the various above embodiments.

The percussive striking member device attachment utilizes for its functionality, that of a flexible hollow or solid cylindrical sleeve or sleeves, and a rounded or other geometric shaped base, which, said parts may function symbiotically, or as stand alone structures, and may include a shell, or shells, known as tips or heads, with a lower, as well as an upper or oppositional opening if desired, in the form of shells, tips, bases, lips annular discs, rings, or sleeves, to allow for a varied application of the technology, to be used in removable/reversible fashion, to be used on the conventional striking end of a drumstick or mallet used in musical performances, to work in conjunction with the sleeve or base/lip/ring, fashioned from polymers, or other material suited for this invention or any combination as noted above, and attached to a drumstick or mallet at said upper-most portion of these or similar objects used to strike a percussion instrument as a stand-alone attachment, or as part of a monolithic/unitary embodiment of the technology, in the form of a solid body drumstick/mallet, or other percussive striking device.

It should be noted that this technology may also be infused into a singular unitary design such as, but not limited to that of a wooden drumstick/mallet, whereby this technology becomes an integral part of the tip or head of this particular embodiment. An example may be referenced via FIG. 5; i.e., a substantially parabaloid design. This Embodiment, featuring an open/floating configuration, would use the neck or uppermost portion of said striking member, to form the open design, with the solid base, exactly as that of its attachable counterpart as per the FIG. 5 Illustration.

The shell, bases, lips, rings, etc. may consist of any recognized materials such as wood, nylon, metal, resin, rubber, lexan, plastic, rubberized cork, silicone gels, rubber yarn, felt, etc, and other materials deemed appropriate. These pieces can be constructed separately, in a conjoined fashion via male/female interlocking threads, pressure fitting, adhesives, and the like, as well as monolithically. They may also be used apart from a shell or tip, to form other unique embodiments as per the present invention in a non-encapsulated fashion.

The unit consisting of a singular, or combination of shells, sleeves, bases, lips, annular rings, etc. may be inserted/capped atop or into a hollow, semi-hollow, or solid shell as noted, with any/all components consisting of any material or combination thereof, used as the striking end for a drumstick or mallet, or any other device so desired, made from materials such as, but not limited to: wood, nylon, felt, synthetic yarn, metal, resin, etc. This piece, or combination of pieces, whether manufactured separately, then attached as noted, or manufactured as two or more distinct pieces, formed into a single unified mold or as one monolithic piece comprising of a shell/tip/head as either encapsulated, or as stand-alone without a shell as noted; thus any combination of parts may be used as monolithic or connected to create any variety of embodiments, or combination thereof, shall also act as a stand-alone striking device. The shell, as noted, may be bored down the center, for example, to be inserted with any combination of sleeves, lips, bases, rings, etc., to be fitted on the inside of the shell itself, to then be attached to the striking end of a stick or mallet, or constructed monolithically.

These parts are connected to each other via a variety of methods such as, but not limited to, being attached through pressure fitting, glue, scoring methods, interlocking male/female joints, sonic welding, or that of a solidified single/monolithic unit, via one or any other means by which this may be accomplished as noted above.

The drumstick or mallet, will act integrally and separately as per the intended and desired use of this invention and the desired manufacturing needs. Sticks/mallets may contain scores/rings, channeled/vertical grooves for interlocking, and may be manufactured via manual/computerized lathes, molds, dyes, templates, or any other means of manufacturing that are readily available, or methods to be implemented by using new technology if applicable.

These components as described, that are to be used in any combination or combinations as noted, may also be retrofitted onto the upper-most portion of any all drumsticks or mallets, to include those manufactured specifically for this invention.

Any/all design embodiments may also be fitted onto the bottom or butt-end of a stick or mallet, in any interchangeable or solidified fashion, as an alternative application of the technology.

Manufacturing methods shall be based on the desired intentions of the invention, which is to flex/move, bounce, float, vibrate, etc. when actuated through the attachment of an external object. In this application, the example of such object would be that of a drumstick/mallet, consisting of a dowel-shaped body with opposed longitudinal ends, of which any singular or combination of components as desired for this invention, shall be attached via connection or said stick may be made monolithically to include the striking member device attachment in future applications. Thus, when the stick strikes a surface such as a drum, this combination of parts shall be given to inducing the above attributes as noted.

The base/lip/ring may be encapsulated by a hollow/solid shell, and attached in segments, or be that of a monolithic unit, with multiple or opposite openings for the insertion of a stick/mallet, and be comprised of but not limited to that of nylon, wood, metal, resin, and press-fitted, glued, interlocked, or scored, as examples of connection, to the sleeve, base/lip/ring, thus attached to the drumstick or mallet. A singular cylindrical sleeve, may be inserted into the lowermost opening of the hollow/solid shell or at any desired length or position, which shall contain a hole(s) of varying measurements to accommodate the insertion of the sleeve into this cavity. Again, this sleeve may be a monolithic unit with a base and shell, or any desired combination. In this example, the sleeve may be scored, thus allowing the hollow/solid shell to be locked or fitted onto the sleeve, or to a singular or multiplicity of annular rings, bases, lips, etc.

It is to be understood that the present invention is not limited to the embodiments described above, but encompasses any and all embodiments within the scope of the following claims.

I claim:

1. A striking member for use with a percussion instrument, the striking member comprising:

a stick having longitudinally opposed first and second ends, the first end being adapted for grasping by the user, an annular groove being formed in the stick adjacent the second end thereof;

a hollow shell having a lower opening formed therethrough, the second end of the stick being received through the lower opening so that the second end at least partially projects within an open interior region of the hollow shell;

means for securing the hollow shell to the second end of the stick, whereby the hollow shell provides for a flexing head of the striking member when the striking member contacts a striking surface; and, an annular ring received within the annular groove of the stick such that when the second end of the stick is received within the hollow shell, the annular ring abuts an exterior surface of said hollow shell about the lower opening formed therethrough, the annular ring being formed from an elastic material.

2. The striking member as recited in claim 1, further comprising an elastic material received within said hollow shell, the elastic material at least partially filling the open interior region thereof.

3. The striking member as recited in claim 2, wherein the elastic material is at least one material selected from the group consisting of urethane, polyurethane, silicone, polyvinyl chloride, acetate, styrene, polystyrene, rubber, cork, rubberized cork, nylon, resin, wood, aluminum, plastic, felt, yarn, string, a spring, metal, and silicone gel.

4. The striking member as recited in claim 3, wherein said hollow shell further has an upper opening formed therethrough the upper opening being adapted for receiving the elastic material.

5. The striking member as recited in claim 1, further comprising a plate mounted on the second end of the stick, the plate being positioned within said hollow shell.

6. A striking member for use with a percussion instrument, the striking member comprising:

a stick having longitudinally opposed first and second ends, the first end being adapted for grasping by the user;

a support member having longitudinally opposed lower and upper ends;

a hollow shell having an opening formed through a lower end thereof, the upper end of the support member being received through the opening so that the upper end at least partially projects within an open interior region of the hollow shell;

means for securing the lower end of the support member to the second end of the stick;

means for securing the upper end of the support member to the hollow shell, whereby the hollow shell provides for a flexing head of the striking member when the striking member contacts a striking surface; and, an annular ring being integrally formed on said support member and forming a raised annulus thereabout, the annular ring abutting an exterior surface of said hollow shell about the opening formed therethrough, the annular ring being formed from an elastic material.

7. The striking member as recited in claim 6, further comprising an elastic material received within said hollow shell, the elastic material at least partially filling the open interior region thereof.

8. The striking member as recited in claim 7, wherein the elastic material is at least one material selected from the group consisting of urethane, polyurethane, silicone, polyvinyl chloride, acetate, styrene, polystyrene, rubber, cork, rubberized cork, nylon, resin, wood, aluminum, plastic, felt, yarn, string, a spring, metal, and silicone gel.

9. The striking member as recited in claim 8, wherein said hollow shell has an upper opening defined therein adapted for receiving the elastic material.

10. The striking member as recited in claim 6, further comprising a plate mounted on the second end of the stick, the plate being positioned within said hollow shell.

11. The striking member as recited in claim 6, wherein said support member is flexible.

12. A striking member for use with a percussion instrument, the striking member comprising:

a stick having longitudinally opposed first and second ends, the first end being adapted for grasping by the user, the second end having a recess formed therein, the recess extending along longitudinally;

a hollow shell having an upper end and a lower end, the hollow shell defining an open interior region;

a support member having longitudinally opposed upper and lower ends, the upper end of the support member being secured to the lower end of the hollow shell and projecting downwardly therefrom, the lower end of the support member being received within the recess formed in the stick;

an elastic material received within the hollow shell, the elastic material at least partially filling the open interior region thereof, whereby the hollow shell provides for a flexing head of the striking member when the striking member contacts a striking surface;

at least one plate mounted on the second end of the stick, the plate being positioned within said hollow shell; and, an annular ring being integrally formed on said support member and forming a raised annulus thereabout, the annular ring abutting an exterior surface of said hollow shell, the annular ring being formed from an elastic material.

13. The striking member as recited in claim 12, wherein the elastic material is at least one material selected from the group consisting of urethane, polyurethane, silicone, polyvinyl chloride, acetate, styrene, polystyrene, rubber, cork, rubberized cork, nylon, resin, wood, aluminum, plastic, felt, yarn, string, a spring, metal, and silicone gel.

14. The striking member as recited in claim 13, wherein said hollow shell has an upper opening and a lower opening defined therethrough, the support member at least partially projecting through the lower opening, the upper opening being adapted for receiving the elastic material.

15. The striking member as recited in claim 14, wherein the annular ring is positioned about the lower opening formed through the hollow shell.

16. The striking member as recited in claim 12, wherein the at least one plate comprises a plurality of plates.

17. The striking member as recited in claim 12, wherein said support member is flexible.

18. The striking member as recited in claim 15, further comprising a secondary annular ring secured to the exterior surface of the hollow shell about the upper opening formed therethrough.

* * * * *